United States Patent [19]

Schell

[11] 4,331,245

[45] May 25, 1982

[54] CARPET SAMPLE DISPLAY RACK

[76] Inventor: Dennis L. Schell, Rte. 1, Olathe, Kans. 66061

[21] Appl. No.: 67,126

[22] Filed: Aug. 16, 1979

[51] Int. Cl.[3] ..... A47F 7/16

[52] U.S. Cl. ..... 211/49 D; 211/45; 211/133

[58] Field of Search ..... 211/45, 46, 133, 49 D, 211/128, 50, 55, 186

[56] References Cited

U.S. PATENT DOCUMENTS

| | | | |
|---|---|---|---|
| 2,943,742 | 7/1960 | Colley | 211/49 D |
| 3,171,543 | 3/1965 | Nelson et al. | 211/45 |
| 3,534,863 | 10/1970 | Howard | 211/47 |
| 3,572,512 | 3/1971 | Schray | 211/133 |
| 3,633,759 | 1/1972 | Jennings | 211/45 |
| 3,871,524 | 3/1975 | Helf | 211/45 |
| 3,997,060 | 12/1976 | Kunin | 211/133 X |
| 4,119,207 | 10/1978 | Fuller et al. | 211/45 |
| 4,183,438 | 1/1980 | Huczek | 211/49 D |

FOREIGN PATENT DOCUMENTS

| | | | |
|---|---|---|---|
| 2132751 | 1/1973 | Fed. Rep. of Germany | 211/45 |

*Primary Examiner*—Roy D. Frazier

*Assistant Examiner*—Robert W. Gibson, Jr.

*Attorney, Agent, or Firm*—Fishburn, Gold and Litman

[57] ABSTRACT

A rack structure for use in a store for storage and display of samples of material such as of carpet, fabrics, and the like comprises opposite end members positioned in spaced, upright relationship for display of large samples, such as sample books thereon, and a plurality of supportive shelf members extending between and connected to the end members. The shelf members have midportions and front portions and a plurality of spaced divider wall members on each of the shelf members extend from the midportions to the front portions and divide each shelf member into a plurality of narrow, side-by-side trays. Front wall members respectively extend along the front portions to close the front of the trays. A plurality of sample pieces of material of relatively small size are received in the trays and removable therefrom for transport from the store whereby the pieces can be taken to a proposed installation site for examination. In one embodiment, front portions of the shelf members are inclined for viewing of the sample pieces and in another embodiment, the trays include resilient retainers which present the pieces for ease of viewing and removal.

1 Claim, 6 Drawing Figures

1
11
18
6
3
5
8
31
31
11
34
9
7
29
5
22
7'
4
2
4
18
15
24
37
4
32
42
43
24
37
4
31
10
17
13
16
21
9
34
19
17

10'
34
31
6
5
8
31
34
7'
10
4.
4.
11
29
38
7

40
38
8
11
31
6
5
9
34
34
10'
10
39
7'
7
39

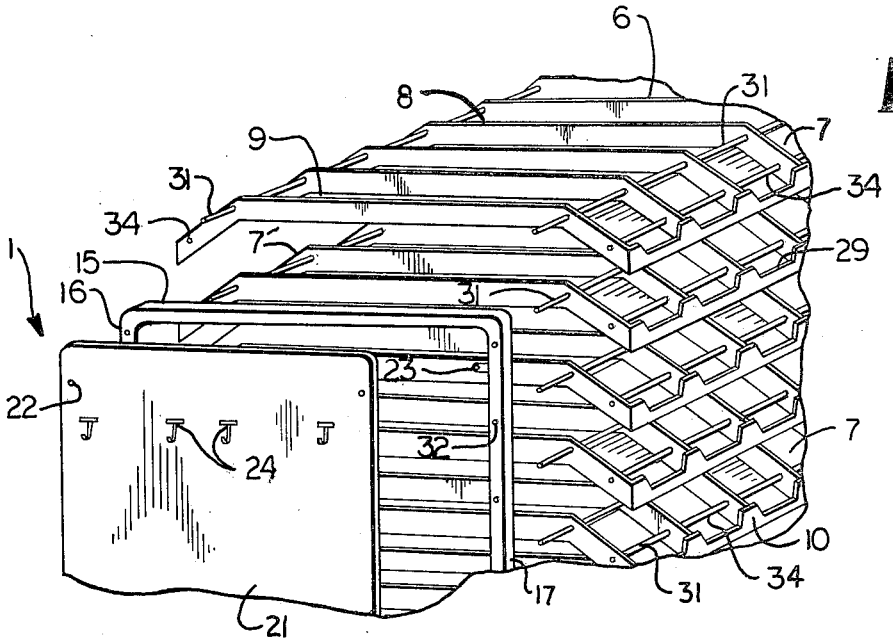
Fig. 2.
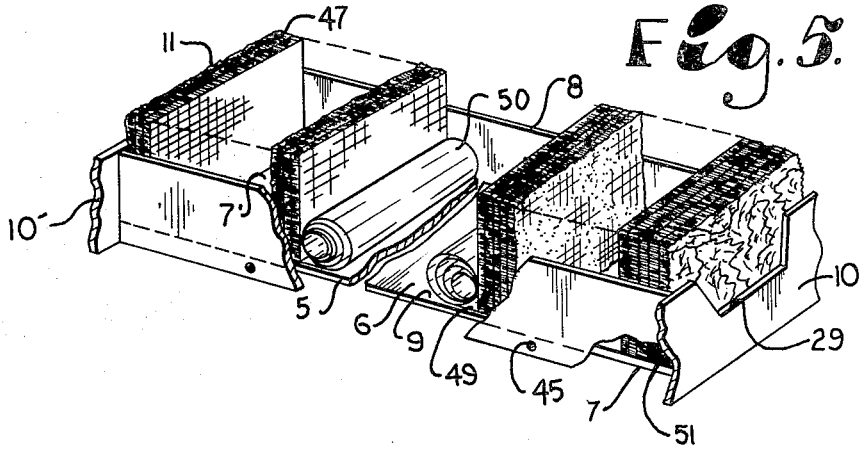
Fig. 5.
Fig. 6.
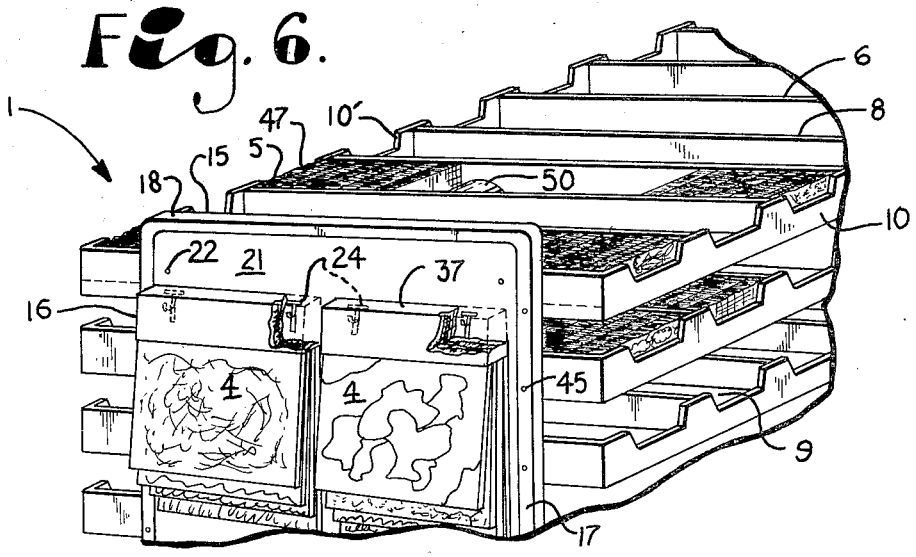

CARPET SAMPLE DISPLAY RACK

This invention relates to rack structures for displaying merchandise and in particular to a storage and display rack for carpet and fabric samples.

A continuing problem with the merchandising of carpet, rugs, fabric and the like goods is the desire of the potential purchaser thereof to remove the goods from the store or place of display and transport the goods to a proposed site of installation for viewing and examination. In this manner, the potential purchaser is able to better coordinate the color, shade and texture of the sample with the furniture, wallpaper or wall color of the room in which installation is considered. Heretofore, the opportunity to take samples or swatches of the goods to the proposed installation site has usually been missed and accordingly, opportunity for sales has sometimes been lost. In other instances, the sample may be stolen or the salesman may permit the potential customer to remove the store's only sample of the carpet or sample, or even take the entire carpet or fabric sample book from the store. Sometimes the potential customer fails to return the sample or book to the store and the same must be reordered from the manufacturer, often at considerable cost. Even when returned, the potential customer may keep the sample or sample book for several weeks before making a decision thereon. In either case, what may be the store's only sample is removed for a period of time and sales of the article may be lost because of the unavailability of merchandise samples to show another prospective customer.

The principal objects of the present invention are: to provide a rack structure for storage and display of samples of material such as carpet, rugs, fabric and the like including large samples or books and small sample pieces or portions of the larger ones whereby the small sample pieces or portions may be removed from the storage rack for viewing at a proposed site of installation; to provide such a rack structure which alleviates the above described problems associated with missing samples of goods such as carpet, rugs, fabric and the like; to provide such a rack structure which presents a plurality of sample pieces or portions of material for view and examination; to provide such a rack structure having supportive shelf members providing a plurality of narrow, side-by-side trays into which sample strips or portions are received; to provide a cutting tool with such a rack structure for cutting off portions of the sample strips for removal from the store and viewing at the site of the proposed installation; to provide such a rack structure having a resilient, retaining member in the trays which is operable to retain sample pieces of portions in an orientation and position for ease of viewing and removal; and to provide such a rack structure which is relatively inexpensive, sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

FIG. 2 is a fragmentary, disassembled view of the rack structure.

FIG. 5 is a fragmentary, perspective view of a tray member of an alternate embodiment of the rack structure.

FIG. 6 is a fragmentary, perspective view of the alternate embodiment of the rack structure.

Figure 1:
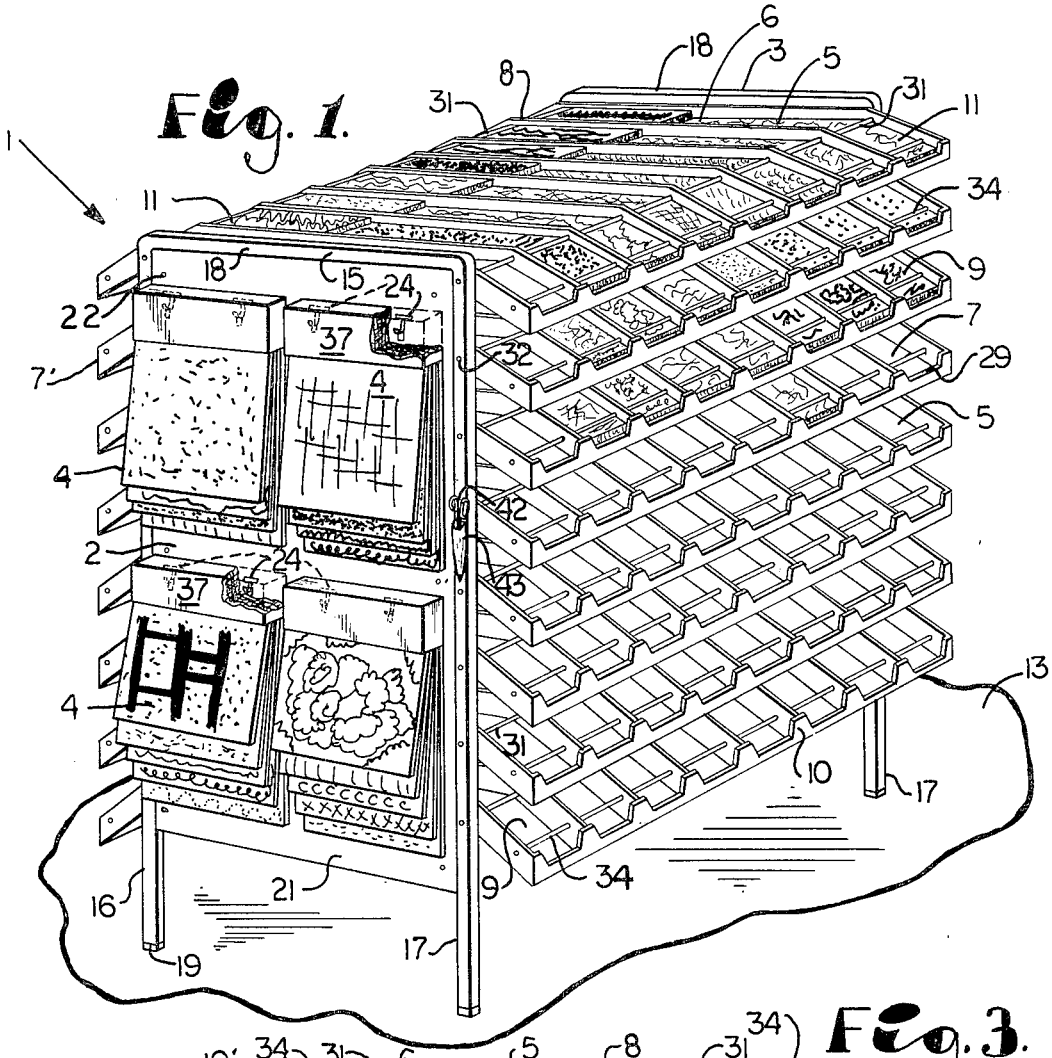
FIG. 1 is a perspective view of a rack structure embodying the present invention and is shown supporting a plurality of sample strips or portions and sample books.
Figure 3:
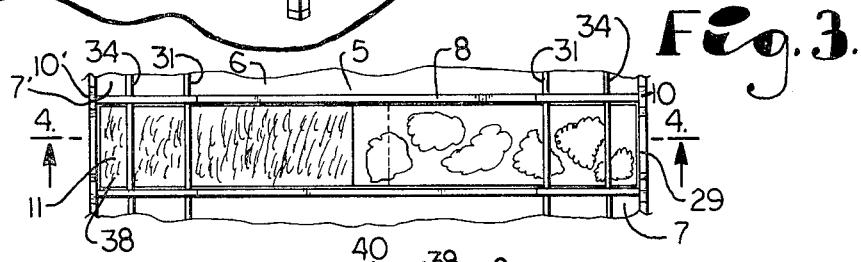
FIG. 3 is a fragmentary top plan view of a tray portion of the shelf member and showing a plurality of sample strips or portions layed therein.
Figure 4:
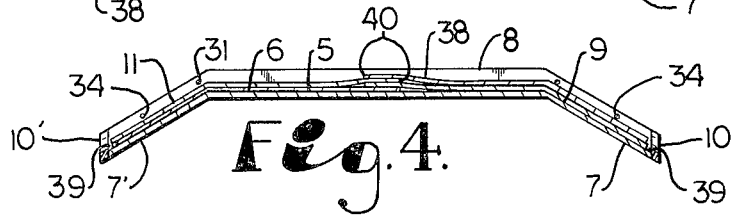
FIG. 4 is a longitudinal sectional view taken along line 4—4, FIG. 3.

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates a rack structure for use in stores and retail business establishments for storage and display of samples of materials or goods such as carpet, rugs, fabric and the like. The rack structure 1 includes opposite end members 2 and 3 positioned in spaced, upright relationship and having surfaces for display of large carpet samples 4 thereon. A plurality of supportive shelf members 5 extend between and are connected to the end members 2 and 3 and respectively have midportions 6 and front and rear portions 7 and 7'. In the illustrated example, divider wall members 8 on each of the shelf members 5 extend between the front and rear portions 7 and 7' and section the shelf members 5 into narrow, side-by-side trays 9 with respective front and rear wall members 10 and 10' extending along the front and rear portions 7 and 7'. A plurality of sample pieces or portions 11 of relatively small size are received in the trays 9 and removable therefrom for transport from the store and viewing at a proposed site of installation.

Intended for use in stores and retail business establishments, the rack structure 1 thereby provides a means for displaying relatively large samples 4 for viewing by a prospective customer. Then, assuming that the prospective customer has narrowed his or her choices to a small number of selections, the rack structure 1 provides a means for permitting the prospective customer to remove selected sample pieces or portions 11 from the storage rack whereby the same can be transported from the store and taken to the proposed site of installation, such as a home, for viewing. In this manner, the color, texture and design of the sample piece or portion 11 can be compared with, for example, existing furniture in the room, color of painted wall surfaces, and texture and design of paper or fabric covered wall surfaces, thereby aiding the prospective purchaser in the selection of a particular style, color and texture of the goods, such as a carpet or rug. Further, the prospective purchaser may desire to take a sample of the goods, such as carpet or rug, home for approval by another, such as in the instance where a wife desires to gain the approval of the husband in the selection.

The rack structure 1 may be permanently mounted adjacent a wall or, as in the illustrated example, FIG. 1, may be free-standing and positioned a floor surface 13.

When standing alone and spaced from a wall, the rack structure 1 is accessible from both the front and rear. The exemplary end members 2 and 3 respectively include a frame 15, such as of bent rectangular tubing and has spaced, upright legs 16 and 17 and an upper transverse member 18. Lower ends of the legs 16 and 17 have a suitable end cap 19, such as of nylon, synthetic rubber or the like fitted thereinto. A panel 21 is received within the frame 15 and suitably attached thereto such as by fasteners 22 which connect to ears 23 positioned inwardly of the frame 15, FIG. 2. In the illustrated example, the plane 21 has means for support of large carpet samples 4 and in the illustrated example, such means include hooks 24 for suspension of the large carpet samples 4 as described below.

The supportive shelf members 5 extend between and are connected to the end members 2 and 3 and the exemplary shelf member midportions 6 are substantially horizontal. Opposite front and rear portions 7 and 7' are positioned along margins of the shelf members 5 and respectively extend outwardly of the front and rear margins of the end members 2 and 3. In the illustrated example, FIGS. 1 through 4, the opposite front and rear portions 7 and 7' are inclined relative to the midportions 6 to present sample pieces or portions 11 situated thereon for easy viewing by a prospective customer. The angle of inclination of the front portion 7 to the midportion 6 in the illustrated example is a 30° angle which presents a sample piece or portion 11 reposing thereon in such an attitude as to appear substantially flat to a person standing adjacent to the rack structure 1.

A plurality of elongate divider wall members 8 are positioned on each of the shelf members 5 and individually extend thereacross and down the opposite inclined front and rear portions 7 and 7' whereby the shelf members 5 are divided into a plurality of narrow, side-by-side trays 9. The front and rear wall members 10 and 10' extend along opposite margins of the shelf member 5 and close the front and rear of the trays 9. In the illustrated examples, the front and rear wall members 10 and 10' include recesses 29 for grasping and viewing the sample pieces or portions 11.

The shelf members 5 are suitably connected to the end members 2 and 3 by connecting means and in the illustrated example, said means include elongate rod members 31 which are of a length greater than the longitudinal dimension of the shelf members 5 and extend through the side wall members 26 and into bores 32 through the legs 16 and 17 of the frame 15. In the illustrated example, the rod members 31 are generally positioned at the juncture of the inclined front and rear portions 7 and 7' with the midportion 6 whereby the inclined front and rear portions 7 and 7' extend outwardly of the margin of the frame legs 16 and 17. Further, the placement of the rod members 31 at the juncture of the midportion 6 with the front and rear portions 7 and 7' provides a retainer or stop against upward movement of the sample piece or portion 11 such as an elongate strip thereof described below. Opposite ends of the rod members 31 are suitably secured to the frame legs 16 and 17 such as by press fit, upsetting or adhesive bonding. Second rod members 34 extend through the divider wall members 8 respectively adjacent the front and rear wall members 10 and 10' in overlying relation to the inclined front and rear portions 7 and 7'. Opposite ends of the second rod members 34 are contained within opposite end divider wall members 8 of the respective shelf members 5.

In the rack structure 1, FIGS. 1 through 4, the large samples 4 include books 37 such as of carpet samples thereof in which the samples 4 are bound together and have rear openings for suspension from the hooks 24. The prospective customer is thereby free to lift the books 37 from the rack structure 1 and peruse the samples 4 therein until deciding upon one or several carpet samples for further consideration. Upon narrowing of the customer's choice to one or several swatches of carpet, fabric, or the like the customer and sales person direct their attention to the sample pieces or portions 11 received within the trays 9 to match the large sample shown in the book 37 to the smaller sample piece or portion 11 in the tray 9. In the examples shown in FIGS. 1 through 4, the sample pieces or portions 11 include strips 38 lying in the trays 9 and having a width dimension generally equal to the distance between the spaced divider wall members 8 and having a length dimension less than the distance between the front and rear wall members 10 and 10'. Each sample strip 38 has first and second ends 39 and 40 with the first end 39 respectively adjacent the front or rear wall members 10 or 10' and the second end 40 on the midportion 6. A second sample strip 38 is positioned in overlying relation to the first sample strip 38 and is laid into the tray 9 so the first end 39 is opposite from the first end 39 of the underlying strip 38. For example, FIGS. 3 and 4, a first strip 38 is positioned with the first end 39 at the rear portion 7' and a second strip 38 is positioned with the first end 39 at the front portion 7. In this manner, the second ends 40 overlap each other and subsequent strips 38 received in the trays 9 repeat the staggered relationship. The strip first ends 39 extend downwardly against the inclined front and rear portions 7 and are thereby presented for viewing by the prospective customer. Preferably, the strips 38 are positioned under the rod members 31 and 34 which serve as hold downs or retainers to position the sample strips 38 in an inclined attitude.

A cutting tool, such as a scissors 42, FIG. 1, is received within a holder 43 positioned, for example, on the end wall 2 and is operable to cut a portion from a selected sample strip 38 for removal of the cut portion from the rack structure 1 whereby the portion can be removed from the store and taken to a proposed installation site for viewing.

In the use of the rack structure 1 as illustrated in FIGS. 1 through 4, a prospective customer selects a sample of material from a book 37 and matches the selected sample with a strip 38 in one of the trays 9. Lifting the first end 39 of the strip 38, the customer pulls a portion of the strip 38 over the appropriate front or rear wall 10 or 10' and, using the scissors 42, cuts a suitably sized fragment therefrom. Preferably, the cut portion has indicia thereon such as on a bottom surface, which identifies the manufacturer, pattern number, color number and other factors which may be relevant to file a subsequent order for the good.

An alternate embodiment of the rack structure 1 is shown in FIGS. 5 and 6 wherein like numerals designate like parts relative to the preferred embodiment as shown in FIGS. 1 through 4. In the alternate embodiment, FIG. 6 the shelf members 5 do not have inclined front and rear portions and in the illustrated example, the shelf members 5 are planar. The shelf members 5 are suitably connected to the legs 16 and 17 of the side members 2 and 3 as by rods 45 extending through the legs 16 and 17 and into contacting portions of the shelf members 5.

In the alternate embodiment, a plurality of sample pieces or portions 11 include relatively small swatches 47 placed on end within each tray 9. In the illustrated example, the swatches 47 are rectangular in shape and preferably of a length dimension to extend substantially between the spaced divider wall members 8 and of a width dimension, so that when stood upright an upper edge of the swatches 47 is positioned slightly above the respective front or rear end wall 10 or 10'. In this orientation, the color and texture of the swatch 47 can be viewed through the recess 29 of the front or rear wall member 10 or 10'.

Resilient means in each of the trays 9 position the swatches 47 adjacent the respective front and rear wall members 10 and 10' for viewing and selective removal and in the illustrated example, the resilient means includes a flexible sheet member 49, such as of plastic or the like, having a memory which tends to form the sheet member 49 into a coil 50 at an end thereof. A free end 51 of the sheet member 49 is suitably secured adjacent the respective front or rear wall member 10 or 10' as by fasteners, adhesives or the like and the sheet member 49 partially uncoiled. The swatches 47 are stacked horizontally between the coil 50 and the respective front or rear wall member 10 or 10' whereby the coil 50 tends to resiliently pull back toward the front or rear wall member 10 or 10' and thereby push the swatches 47 therealong and toward the wall members 10 or 10'.

In use of the alternate embodiment of the rack structure 1 as illustrated in FIGS. 5 and 6, the prospective customer selects a specimen from the large samples 4 as described above in connection with FIGS. 1 through 4. The customer then peruses the rack structure 1 until the corresponding sample piece or portion 11, such as the swatches 47, is identified and the swatch 47 is then grasped and pulled from the tray 9. The resilient sheet member 49 then further coils and pushes the horizontal stack of swatches 47 to fill the space left by the removed swatch 47.

It is to be understood that while forms of this invention have been illustrated and described, it is not to be limited to the specific form or arrangement of parts herein described and shown, except insofar as such limitations are included in the following claims.

What is claimed and desired to secure by Letters Patent is:

1. A movable, free-standing rack structure for use in a retail store for storage and display of carpet samples and comprising:

(a) opposite end panel members positioned in spaced, upright relationship, at least one of said panel members having fasteners thereon for supporting a plurality of large carpet samples thereon;

(b) leg members extending from said end panel members for contact with a floor surface;

(c) a plurality of supportive shelf members extending between and connected to said end panel members to form a free-standing rack structure, said shelf members respectively having generally planar midportions and downwardly inclined front and rear portions;

(d) elongate side wall members on each of said shelf members extending from said front to rear portions and dividing said shelf members into narrow, side-by-side trays and front and rear wall members respectively extending along said front and rear portions;

(e) rod members extending between and connected to said end panel members and extending through said side wall members at junctures of said shelf member midportions with said front and rear portions;

(f) a plurality of elongate carpet sample strips matching said large carpet samples and lying in said trays and having a width for fitting between said side wall members and a length less than the distance between said front and rear wall members, said carpet sample strips having first and second ends with the first ends respectively on said front and rear portions and the second ends in overlapped relationship, said carpet sample strips underlying said rod members and extending down said front and rear portions for display and view thereof by a prospective purchaser; and (g) a cutting tool engageable on said rack structure and operable for cutting a portion from a selected carpet sample strip for removal from said rack structure whereby said portion can be removed from said store and taken to a proposed installation site for viewing.

* * * * *